US012017121B2

(12) United States Patent
Conrad

(10) Patent No.: US 12,017,121 B2
(45) Date of Patent: Jun. 25, 2024

(54) TRAMPOLINE

(71) Applicant: Eurotramp-Trampoline Kurt Hack GmbH, Weilheim/Teck (DE)

(72) Inventor: Bastian Conrad, Esslingen (DE)

(73) Assignee: Eurotramp-Trampoline Kurt Hack GmbH, Wellheim/Teck (DE)

( * ) Notice: Subject to any disclaimer, the term of this patent is extended or adjusted under 35 U.S.C. 154(b) by 78 days.

(21) Appl. No.: 17/960,840

(22) Filed: Oct. 6, 2022

(65) Prior Publication Data

US 2023/0107282 A1 Apr. 6, 2023

(30) Foreign Application Priority Data

Oct. 6, 2021 (EP) ..... 21201129

(51) Int. Cl.
*A63B 5/11* (2006.01)

(52) U.S. Cl.
CPC ..... *A63B 5/11* (2013.01); *A63B 2209/00* (2013.01)

(58) Field of Classification Search
CPC ... A63B 5/11; A63B 2209/00; A63B 71/0054; A63B 5/00; A63B 5/08; A63B 5/10; A63B 5/12; A63B 5/16; A63B 6/00; A63B 6/02
See application file for complete search history.

(56) References Cited

U.S. PATENT DOCUMENTS

| | | | | | |
|---|---|---|---|---|---|
| 3,983,585 | A * | 10/1976 | Sidlinger | A63B 5/11 | 182/139 |
| 4,331,329 | A * | 5/1982 | Mirkovich | A63B 5/11 | 482/27 |
| 5,816,956 | A * | 10/1998 | Ellis | A63B 61/00 | 473/492 |
| 6,001,045 | A * | 12/1999 | Gift | A63B 5/11 | 482/28 |
| 6,017,292 | A * | 1/2000 | Gift | A63B 5/11 | 482/28 |
| 6,139,474 | A * | 10/2000 | Gift | A63B 71/0054 | 482/28 |
| 9,358,412 | B2 * | 6/2016 | Nelson | A63B 21/023 | |
| 9,682,264 | B1 * | 6/2017 | Chen | A63B 71/0054 | |
| 10,232,208 | B2 * | 3/2019 | Chen | A63B 71/022 | |
| 10,434,350 | B2 * | 10/2019 | Chen | A63B 71/04 | |
| 11,285,370 | B2 * | 3/2022 | Shorma | A63B 6/00 | |
| 2002/0137598 | A1 * | 9/2002 | Publicover | A63B 5/11 | 482/27 |
| 2004/0107491 | A1 * | 6/2004 | Publicover | E04H 4/108 | 4/498 |
| 2005/0032609 | A1 * | 2/2005 | Nissen | A63B 5/11 | 482/27 |
| 2009/0264042 | A1 * | 10/2009 | Chen | A63G 31/12 | 446/221 |

(Continued)

FOREIGN PATENT DOCUMENTS

EP 2208512 B2 3/2014

*Primary Examiner* — Garrett K Atkinson
(74) *Attorney, Agent, or Firm* — Michael Soderman

(57) ABSTRACT

A trampoline (1) with a jumping mat (6) fastened to a frame structure (2) by elastic elements, and with a frame cover (8) covering the top side of the frame structure (2) and the elastic elements. The frame cover (8) has a multilayer structure, whose layers are made of different materials. Alternatively or additionally, the frame cover (8) has a spatially varying height profile.

15 Claims, 2 Drawing Sheets

(56) References Cited

U.S. PATENT DOCUMENTS

| | | | | |
|---|---|---|---|---|
| 2016/0030794 | A1* | 2/2016 | Yang | A63B 5/11 482/28 |
| 2016/0296781 | A1* | 10/2016 | Andon | A63B 5/11 |
| 2017/0173437 | A1* | 6/2017 | Chen | A63B 5/11 |
| 2018/0036569 | A1* | 2/2018 | Chen | A63B 71/0054 |
| 2018/0036570 | A1* | 2/2018 | Chen | A63B 71/022 |
| 2018/0290000 | A1* | 10/2018 | Chen | A63B 71/022 |

* cited by examiner

TRAMPOLINE

CROSS REFERENCE TO RELATED APPLICATIONS

This application claims the priority of EP 21201129.0 filed on 2021, Oct. 6; this application is incorporated by reference herein in its entirety.

BACKGROUND

The invention relates to a trampoline.

Large numbers and various types of such trampolines are used as sports equipment, both for recreational use and competitive sports.

Such trampolines generally have a frame structure on which a jumping mat is mounted by means of elastic elements. The jumping mat forms a jumping surface lying in a horizontal plane, on which a user of the trampoline can perform jumps.

Such a trampoline is known from EP 2 208 512 B2. This trampoline has a frame structure with a frame extending in a horizontal plane and feet opening out at the bottom of the frame for placing the trampoline on a base, in particular a floor. The elastic elements, formed as springs, are clamped in the frame.

If a user performs jumps on the trampoline, the user may step into the area of the elastic elements, which may cause injuries.

To prevent this, the trampoline has a frame cover that covers the top side area of the frame and the elastic elements. The frame cover is made of a foam layer.

SUMMARY

The invention relates to a trampoline (1) with a jumping mat (6) fastened to a frame structure (2) by elastic elements, and with a frame cover (8) covering the top side of the frame structure (2) and the elastic elements. The frame cover (8) has a multilayer structure, whose layers are made of different materials. Alternatively or additionally, the frame cover (8) has a spatially varying height profile.

DETAILED DESCRIPTION

The object of the invention is to provide a trampoline of the type mentioned at the beginning, which has high functional safety.

The features of claim 1 are intended to provide a solution to this object. Advantageous embodiments of the invention and appropriate further developments are described in the dependent claims.

The invention relates to a trampoline with a jumping mat fastened to a frame structure by elastic elements, and with a frame cover covering the top side of the frame structure and the elastic elements. The frame cover has a multilayer structure, whose layers are made of different materials. Alternatively or additionally, the frame cover has a spatially varying height profile.

The frame cover according to the invention significantly increases the functional safety of the trampoline.

The frame cover, in a manner known per se, completely covers the top side of the frame structure and the elastic elements mounted thereto, which are used to fasten the jumping mat, i.e. the frame cover is mounted on the top side of the frame structure and the elastic elements. The frame cover is fastened to the frame structure and thus fixed in position so that it cannot slip when the trampoline is being used.

The frame cover thus generally performs a protective function in such a way that it prevents a user from directly hitting the frame structure or the elastic elements when performing jumps, which could lead to injuries.

By designing the frame cover according to the invention in the form of a multi-part structure made of layers with different materials, the damping effect can be adapted to the frame structure and the elastic elements, wherein in particular the multilayer structure can vary locally in order to create a different damping behavior specifically for the area in which the frame cover rests on the frame structure and for the area in which the frame cover rests on the elastic elements, which damping behavior is adapted to the frame structure on the one hand and to the elastic elements on the other hand. The spatial variation of the multilayer structure takes into account that the frame structure forms a hard substrate, while the elastic elements are elastically deformable and yielding. Accordingly, the multilayer structure is advantageously formed in such a way that it exhibits a stronger damping effect in the area of the frame structure than in the area of the elastic elements.

Alternatively or additionally, the height profile of the frame cover according to the invention also varies. This also allows the damping behavior of the frame cover to be adapted to the structure of the trampoline area by area. Since the damping effect of the frame cover is greater when its height is greater, it is expedient to design the frame cover in such a way that its height is greater in the area of the frame structure than in the area of the elastic elements.

This not only adapts the damping behavior of the frame cover to the structure of the trampoline, but also ensures rational, cost-effective production of the frame cover, since the lower height of the frame cover in the area of the elastic elements results in considerable material savings.

According to an advantageous embodiment of the invention, the multilayer structure has a base layer made of a PE (polyethylene)-based foam and a build-up layer made of a PU (polyurethane)-based foam.

The base layer and the build-up layer are thus made of materials with different damping behavior. With these two layers, the multilayer structure can be formed in such a way that the damping method of the frame cover is optimally adapted to the structure of the trampoline.

The base layer is either made entirely of polyethylene or contains polyethylene as the main component. Advantageously, the build-up layer is made almost entirely of polyurethane. In addition, it only contains additives that are required to produce the foam from a liquid base material.

In the multilayer structure formed in this way, the build-up layer is heavier and at the same time has a lower compression hardness than the base layer.

Advantageously, the base layer has a supporting surface for resting on the top side of the frame structure and on the elastic element. The base layer extends over the entire area of the top side of the frame structure and the elastic elements. In particular, the build-up layer is mounted on segments of the base layer.

Thus, the base layer forms a base layer that rests on the top side of the frame structure and on the elastic elements. The build-up layer, on the other hand, is mounted on the base layer and thus forms the top side of the multilayer structure, at least in sections. This is a favorable arrangement because the build-up layer has a stronger damping effect, and this damping effect is better transmitted to the user when the build-up layer is arranged on the top side of the multilayer structure.

Since the frame structure is harder and more rigid than the elastic elements, it is advisable for the build-up layer to extend over the area of the frame structure in order to achieve the highest possible damping and protective effect in this area. In principle, it is sufficient if the build-up layer also extends to the area where the elastic elements are connected to the frame structure, since the frame cover should also have, for the purpose, a high protective effect in this area.

In order to achieve dimensional stability of the frame cover, in particular of the multilayer structure, it is advantageous if the base layer and the build-up layer are connected to each other by fixing means.

Fixing can be achieved with suitable adhesives or adhesive tapes. Furthermore, mechanical fastenings are also possible. For example, there may be recesses or projections on the build-up layer or base layer which interlock in pairs.

According to an advantageous embodiment, the height profile of the frame cover is formed in such a way that the height of the frame cover assumes a maximum value in the area of the top side of the frame structure.

This ensures that the protective effect, i.e. the damping effect, is at a maximum in the area of the frame structure.

Further advantageously, in an edge region of the frame cover adjacent to the jumping mat, the height of the frame cover assumes a minimum value.

In the boundary area of the jumping mat, only a small damping effect of the frame cover is required, so that it is sufficient if the frame cover has its minimum height in this area. Furthermore, this ensures that no tripping hazard is created for the user, since the frame cover tapers off flat towards the jumping mat.

Further advantageously, in a transition area of the frame cover, its height decreases continuously from the maximum value to the minimum value. The transition area of the frame cover is located in the area of the elastic elements.

In this way, the frame cover has no obstructive edges or ledges that could create tripping hazards.

The frame cover formed in this way has a wedge-shaped cross-section. The frame cover can extend over the entire circumference of the trampoline without any gaps. The cross-section of the frame cover is essentially constant, resulting in a homogeneous, uniform protective effect around the circumference of the trampoline. Advantageously, the frame cover according to the invention extends only along the longitudinal sides of the rectangular trampoline. Flat, conventional frame covers can be provided on the narrow end faces of the trampoline, since landing mats which provide protection from injury are usually connected in these areas.

The protective effect of the frame cover according to the invention is further increased by the fact that the frame cover according to the invention has cover elements which cover the frame structure laterally.

Owing to their damping effect, the lateral cover elements protect a user who bumps into the frame structure from the side.

According to an advantageous embodiment, the multilayer structure of the frame cover is wrapped with a covering, wherein fixing means are provided for fixing the multilayer structure to the covering and for fixing the covering to the frame.

First fixing means provide positional stability of the multilayer structure in the covering. Advantageously, the underside of the multilayer structure is laminated in places with a rough layer.

The covering can be fixed in position on these roughened segments with Velcro strips or the like. This Velcro connection can be unfastened at any time, for example, to replace the multilayer structure or the covering.

Further fixing means are used to fix the covering and thus the frame cover to the frame structure of the trampoline. These fixing means can be formed by pockets on the underside of the covering, which are inserted into brackets arranged in the area of the elastic elements and connected to the frame structure. Alternatively or additionally, locking means such as locking knobs can be provided for fixing cover elements for the frame cover to the frame structure.

The frame cover according to the invention can be used for trampolines of different types and sizes. Advantageously, the frame cover forms a module that can also be installed subsequently on a trampoline.

BRIEF DESCRIPTION OF THE DRAWINGS

The invention is explained below on the basis of the drawings. The drawings show.

DETAILED DESCRIPTION OF THE PREFERRED EMBODIMENTS

Figure 1:
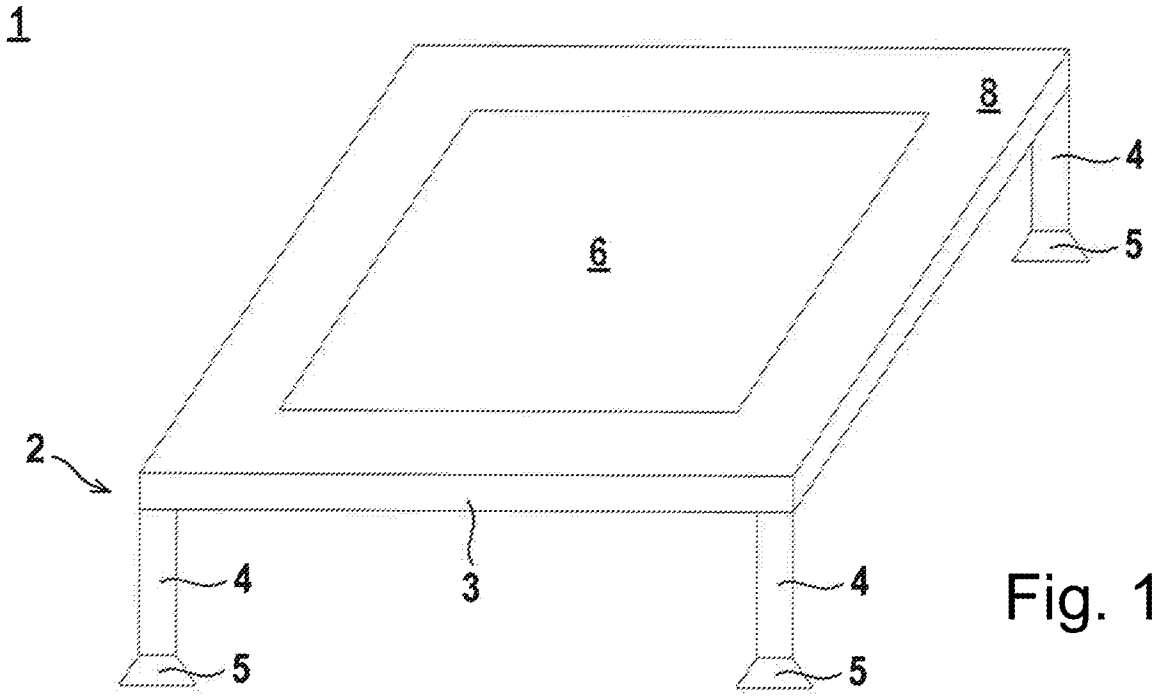
FIG. 1: A schematic representation of an embodiment example of the trampoline according to the invention.

FIG. 1 schematically shows an embodiment example of the trampoline 1 according to the invention.

The trampoline 1 has a frame structure 2. This comprises a substantially rectangular frame 3 oriented in a horizontal plane. Support feet 4 open out from the underside of the frame 3 in the area of its corners. The longitudinal axes of the identical support feet 4 run in a vertical direction. The support feet 4 are used to stand the trampoline 1 on a surface, for example a floor of a hall. Supporting elements 5 are located on the undersides of the supporting feet 4 to ensure good footing on the base.

The frame structure 2 advantageously consists of a profile or tube structure made of metallic material.

A jumping mat 6 is clamped in the frame 3 of the frame structure 2. The jumping mat 6 is fastened to the frame 3 by elastic elements in the form of springs 7, as shown in particular in FIG. 2. The jumping mat 6 may, for example, be made of a woven fabric or an arrangement of crossed bands. The top side of the jumping mat 6 thus forms a jumping surface on which a user can perform jumps.

To prevent the user from landing on the frame 3 or the elastic elements during the jumps, a frame cover 8 is provided to cover the top side of the frame 3 and thus of the frame structure 2 and also the elastic elements. The frame cover 8 extends around the entire circumference of the trampoline 1, as shown in FIG. 1.

Figure 2:
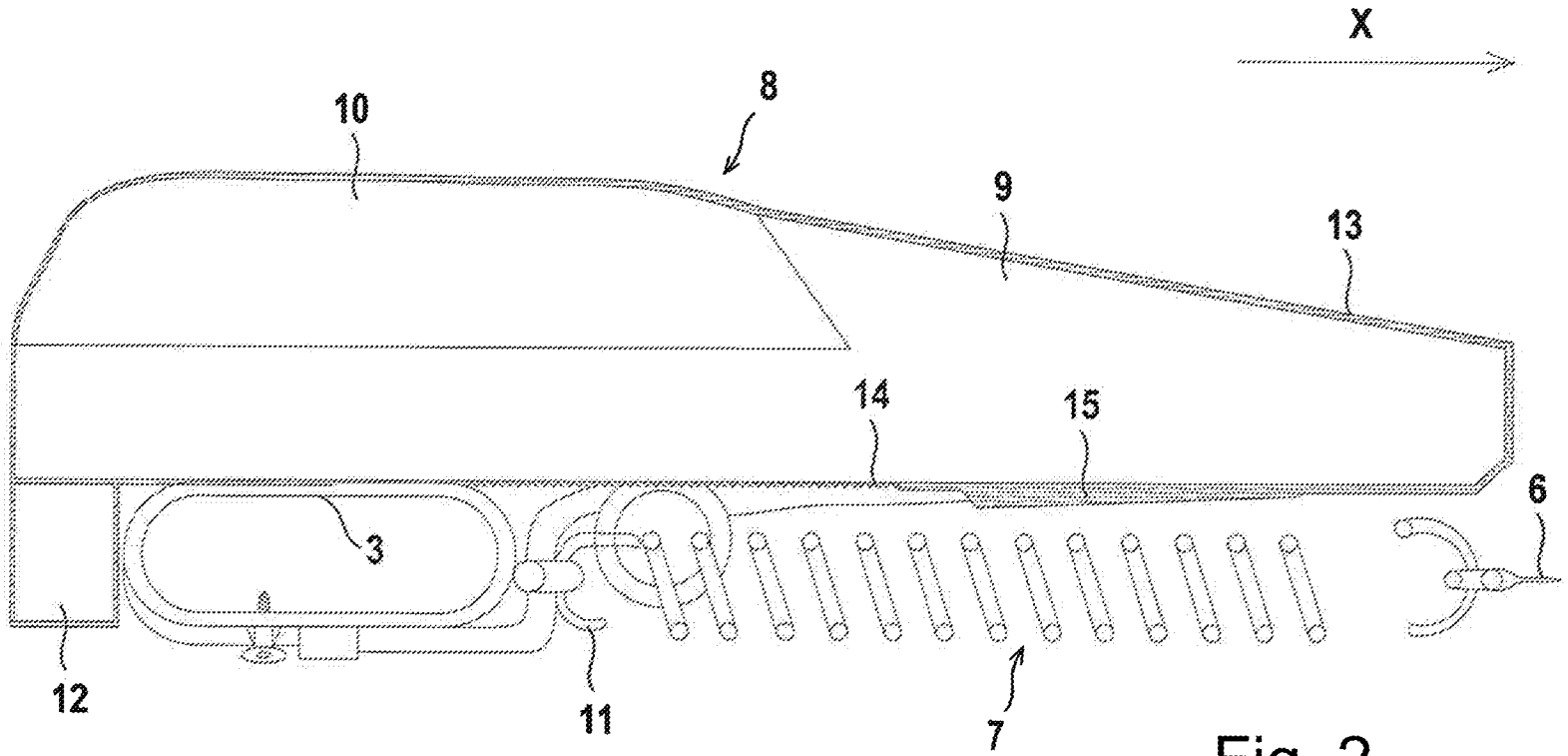
FIG. 2: Sectional view of a part of the trampoline according to FIG. 1.

FIG. 2 shows a sectional view of the frame cover 8 according to the invention. According to the invention, the frame cover 8 has a multilayer structure made of a plurality of layers of different materials. In addition, the frame cover 8 has a location-dependent height profile. In this case, there is a location dependency in the x-direction, as shown in FIG. 2, wherein this directional arrow runs from a lateral edge of the frame structure 2 towards the center of the trampoline 1.

In contrast, the cross-section of the frame cover 8 is constant in the circumferential direction of the trampoline 1 with the exception of the corner areas. In the corner areas, the frame cover 8 is extended due to its geometry.

As FIG. 2 shows, the multilayer structure of the frame cover 8 in the present case is made of two layers, namely a base layer 9 and a build-up layer 10. Both layers are formed as foam layers and thus have elastic, damping properties. The base layer 9 consists essentially of PE (polyethylene). The build-up layer 10 is made of a PU (polyurethane)-based foam.

The underside of the base layer 9 rests on the frame 3 and the springs 7 fastened thereto. Thus, the frame cover 8 completely covers the frame 3 and the springs 7, i.e. the elastic elements, up to the jumping mat 6 and thus conceals all sources of danger to which the visitor would otherwise be exposed when performing jumps on the trampoline 1.

The build-up layer 10 lies in a recess in the base layer 9, wherein this recess is provided on the top side of the base layer 9. The form of the build-up layer 10 is adapted to the form of the recess so that the build-up layer 10 abuts the interfaces of the base layer 9 without any gaps.

The build-up layer 10 is held to and secured in position on the base layer 9 by fixing means. In the present case, the fixing means are formed by adhesives or adhesive tapes, which are not shown separately in FIG. 2.

As can be seen from FIG. 2, the build-up layer 10 extends only over the area of the frame 3 and the adjoining coupling means for connecting the springs 7 to the frame 3, wherein the coupling means in the present case are hooks 11.

In contrast to the springs 7, which are elastically deformable, the rigid frame 3 poses an increased risk of injury. Accordingly, the frame cover 8 has an increased damping effect in the area of the frame 3, which is achieved by the build-up layer 10 in the area of the frame 3.

Furthermore, an increased damping effect in the area of the frame 3 is achieved by the frame cover 8 having a height profile that varies in the x-direction, as shown in FIG. 2. As can be seen from FIG. 2, the height of the frame cover 8 has a maximum value in the area of the frame 3, so that a particularly large damping effect is achieved in this area. From this maximum value, the height of the frame cover 8 continuously decreases in the area of the springs 7 to a minimum value obtained at the edge region of the frame cover 8 adjacent to the jumping mat 6. Thus, a wedge-shaped cross-section of the frame cover 8 is obtained. The maximum value is advantageously about 8 cm, the minimum value about 2 cm. In general, the height range of the frame cover 8 is in the single-digit cm range.

Since no greater damping effect of the frame cover 8 is required in the area of the springs 7, the height of the frame cover 8 steadily decreases in this area, which also results in material savings in the manufacture of the frame cover 8. Since the frame cover 8 tapers off flat towards the jumping mat 6, unwanted tripping hazards are also avoided.

As FIG. 2 shows, the protective function of the frame cover 8 is extended in that it has cover elements 12 located on the side of the frame 3 which, due to their damping effect, protect a user from bumping against the frame 3 from the side.

In the present case, the cover elements 12 have a rectangular cross-section and are fastened to the underside of the frame cover 8, for example by adhesive means. Like the base layer 9, the cover elements 12 are advantageously made of a PE foam. In principle, the cover elements 12 can also be formed in one piece with the base layer 9.

As FIG. 2 shows, the frame cover 8 is covered with a covering 13, which in the present case is made of PVC.

A roughened layer is provided on the underside of the frame cover 8. The covering 13 can be fixed to this layer, for example, by means of Velcro strips.

Furthermore, brackets 14 are pivotably mounted to fix the frame cover 8 to the frame 3. The brackets 14 are preferably distributed around the circumference of the frame 3 at predetermined distances from each other. The brackets 14 engage in pockets 15 on the underside of the covering 13 (FIG. 2) and in this way provide positional fixation of the frame covering 8 relative to the frame 3.

LIST OF REFERENCE NUMERALS (1) Trampoline
(2) Frame structure
(3) Frame
(4) Support foot
(5) Supporting element
(6) Jumping mat
(7) Spring
(8) Frame cover
(9) Base layer
(10) Build-up layer
(11) Hook
(12) Cover element
(13) Covering
(14) Brackets
(15) Pockets

The invention claimed is:

1. A trampoline (1) with a jumping mat (6) fastened to a frame structure (2) by elastic elements, and with a frame cover (8) covering the top side of the frame structure (2) and the elastic elements, characterized in that the frame cover (8) has a multilayer structure, the layers of which are made of different materials, and that the frame cover (8) has a spatially varying height profile with a wedge-shaped cross-section, and that the frame cover (8) develops a stronger damping effect in the area of the frame structure (2) than in the area of the elastic elements because of the multilayer structure and the height profile.

2. The trampoline (1) according to claim 1, characterized in that the multilayer structure varies spatially.

3. The trampoline (1) according to claim 1, characterized in that the multilayer structure has a base layer (9) made of a PE (polyethylene)-based foam and a build-up layer (10) made of a PU (polyurethane)-based foam.

4. The trampoline (1) according to claim 2, characterized in that a base layer (9) has a supporting surface for placement on the top side of the frame structure (2) and on the elastic element.

5. The trampoline (1) according to claim 3, characterized in that the build-up layer (10) is mounted on segments of the base layer (9).

6. The trampoline (1) according to claim 3, characterized in that the base layer (9) extends over the entire area of the top side of the frame structure (2) and the elastic elements.

7. The trampoline (1) according to claim 3, characterized in that the build-up layer (10) extends only over the area of the top side of the frame structure or only over the area of the top side of the frame structure (2) with a connection area of the elastic elements to the frame structure (2).

8. The trampoline (1) according to claim 3, characterized in that the base layer (9) and the build-up layer (10) are connected to each other by fasteners.

9. The trampoline (1) according to claim 1, characterized in that the height of the frame cover (8) assumes a maximum value in the area of the top side of the frame structure.

10. The trampoline (1) according to claim 9, characterized in that in an edge region of the frame cover (8) adjacent to the jumping mat (6), the height of said frame cover assumes a minimum value.

11. The trampoline (1) according to claim 10, characterized in that in a transition area of the frame cover (8) its height continuously decreases from the maximum value to the minimum value.

12. The trampoline (1) according to claim 11, characterized in that the transition area of the frame cover (8) is located in the area of the elastic elements.

13. The trampoline (1) according to claim 1, characterized in that the frame cover (8) has a wedge-shaped cross-section.

14. The trampoline (1) according to claim 1, characterized in that the frame cover (8) has cover elements (12) which cover the frame structure laterally.

15. The trampoline (1) according to claim 1, characterized in that the multilayer structure of the frame cover (8) is wrapped with a covering (13), wherein fasteners are provided for fixing the multilayer structure to the covering (13) and for fixing the covering (13) to the frame (3).

* * * * *